US008919309B2

(12) United States Patent
Jensen et al.

(10) Patent No.: US 8,919,309 B2
(45) Date of Patent: Dec. 30, 2014

(54) METHOD AND MECHANISM TO CONFIRM ENGINE TIMING

(71) Applicants: Braydon Jensen, Santaquin, UT (US); Val Jensen, Santaquin, UT (US)

(72) Inventors: Braydon Jensen, Santaquin, UT (US); Val Jensen, Santaquin, UT (US)

( * ) Notice: Subject to any disclaimer, the term of this patent is extended or adjusted under 35 U.S.C. 154(b) by 0 days.

(21) Appl. No.: 13/664,711

(22) Filed: Oct. 31, 2012

(65) Prior Publication Data

US 2014/0116364 A1 May 1, 2014

(51) Int. Cl.
*F01L 1/34* (2006.01)
*F02D 41/00* (2006.01)
*F02P 7/067* (2006.01)

(52) U.S. Cl.
CPC ..... *F01L 1/34* (2013.01); *F02D 41/009* (2013.01); *F01L 2820/042* (2013.01); *F01L 2820/041* (2013.01); *F02P 7/067* (2013.01)
USPC ..... 123/90.17; 123/90.15; 464/160

(58) Field of Classification Search
USPC ..... 123/90.31, 90.15, 90.17; 464/160
See application file for complete search history.

(56) References Cited

U.S. PATENT DOCUMENTS 6,386,165 B1 * 5/2002 Eisenmann et al. ..... 123/90.17
6,895,912 B2 * 5/2005 Saruwatari et al. ..... 123/90.15
7,438,033 B2 * 10/2008 Moriya ..... 123/90.17

* cited by examiner

*Primary Examiner* — Ching Chang
(74) *Attorney, Agent, or Firm* — The Law Office of Jerry D. Haynes

(57) ABSTRACT

A mechanism and method of confirming engine timing in an internal combustion engine includes two embodiments, which delay the rotation of the camshaft until confirmation that the engine is properly timed based upon the sensors provided by the electronic control systems of the motor vehicle. In one embodiment, a cam gear assembly is joined to the camshaft to enable proper confirmation that the engine is properly timed before enabling the rotation of the camshaft. In a second embodiment, a gear assembly is used in conjunction with a crankshaft. The crank gear assembly includes an outer ring and an inner ring. A brake is provided in the inner ring to prevent movement until sensors in the vehicle have confirmed proper timing of the engine.

1 Claim, 3 Drawing Sheets

METHOD AND MECHANISM TO CONFIRM ENGINE TIMING

CROSS REFERENCE TO OTHER APPLICATIONS

This application claims priority to U.S. Provisional Application Ser. No. 61/595,231 filed on Feb. 6, 2012.

BACKGROUND OF THE INVENTION

1. Field of Invention

The present invention relates to a mechanism and method that confirms engine timing working in conjunction with the camshaft and crankshaft of a motor vehicle.

2. Description of Related Art

It is critical that an internal combustion engine maintain proper ignition timing. The ignition timing is the spark ignition as related to the piston position and a crankshaft velocity. The ignition timing further relates to the rotation of the camshaft and crankshaft. Valves above the piston control the flow of the air and fuel mixture intake where the valves are opened and closed at appropriate times during the stroke of the piston. The camshaft and crankshaft usually connect through the use of a timing belt or timing chain. The camshaft is used to operate the puppet valves that open and close based upon the stroke of the piston. The ignition is timed so that sparks occur at a appropriate time providing maximum consumption of the gas and fumes that are released in the piston to generate the most power from the power stroke of the engine. Most modern engines utilize electronic computer controls to control the timing of the vehicle. Improper timing may cause damage to the engine and cause excessive fuel consumption. It would be beneficial therefore to have an additional mechanism to ensure that timing is in line prior to the release of the camshaft for operation of the engine.

SUMMARY OF THE INVENTION

The present invention relates to a cam gear assembly for confirming proper engine timing comprising: a drive unit; a torque converter, where the torque converter joins to the drive unit and the torque converter includes a first disc and second disc; a gear housing, where the first disc is an outer gear and second disc is the inner gear filled with oil between blades of the outer gear and inner during operation; and a camshaft, where the camshaft is connected to the cam gear assembly. An input shaft is provided for the connection of the cam gear assembly to the camshaft. During operation, the first disc spins by force supplied by a drive belt. A magnet sensor located above the first disc senses the speed of the first disc and the second disc, once the first disc and outer disc reach a coupling speed and a crankshaft position sensor indicates that the valves and pistons are in a timed position, an electronic solenoid releases and allows the first disc and second disc to synchronize and spin together. Once the first disc and second disc of the torque converter are rotating together, the camshaft is enabled to rotate for operation through a properly timed engine.

A second embodiment of the present invention relates to a crank gear assembly for confirming proper engine timing within a vehicle comprising: an outer ring; an inner ring, where the inner ring includes a brake to prevent movement until sensors in the vehicle have confirmed proper timing of an engine within the vehicle, where the inner ring and outer ring turn together; and a timing belt, where the timing belt turns the outer ring, upon confirmation that valves and pistons of the engine have been properly timed. The outer ring rotates in conjunction with the rotation of a camshaft and the outer ring synchronizes with the inner ring, which is allowed to rotate upon the release of the brake. Once turning together, the outer ring and inner ring enable the rotation of a crankshaft.

DETAILED DESCRIPTION

The present invention relates to a mechanism and method of confirming engine timing in an internal combustion engine. The present invention includes two embodiments that delay the rotation of the camshaft until confirmation that the engine is properly timed based upon the sensors provided by the electronic control systems of the motor vehicle.

Figure 1:
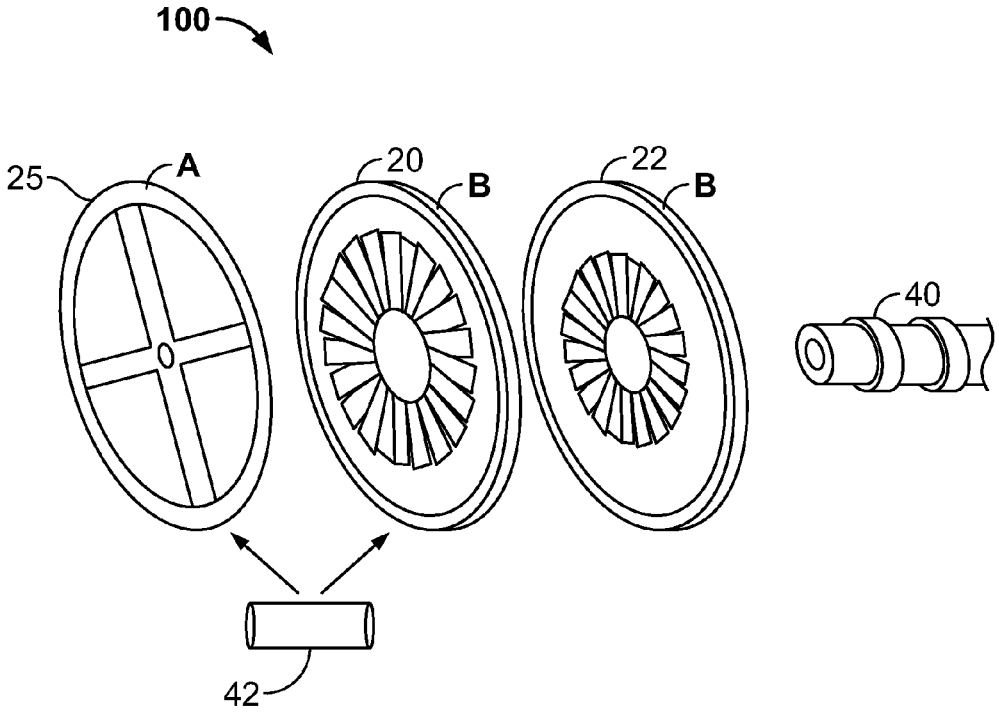
FIG. 1 depicts an exploded view of components used in conjunction with the camshaft to ensure proper timing has been accomplished by an internal combustion engine.

As is well known, many motor vehicles include numerous sensors to detect the overall parameters and operating conditions of the engine. One of the more critical sensors is the sensor involving the timing of the engine. Ignition timing is critical to effective and efficient performance of an engine. The present invention provides a cam gear assembly that is joined to the camshaft to enable proper confirmation that the engine is properly timed before enabling the rotation of the camshaft. In reference to FIG. 1, a depiction of a cam gear assembly 100 in accordance with the present invention is provided. The cam gear 100 and includes a drive unit 25 that joins to a torque converter that includes disc 20 and disc 22. Disc 20, 22 form a gear housing, where disc 20 is an outer gear and disc 22 is the inner gear filled with oil between the blades during operation. This cam gear assembly is connected to a camshaft 40 in FIG. 1. An input shaft 42 is provided for the connection of the cam gear assembly 100 to a camshaft 40. During operation, the outer disc 20 spins by force supplied by a drive belt. A sensor, in particular, a magnet sensor is located above the outer disc, although not shown, that senses the speed of the inner and outer discs. Once these discs reach a coupling speed and the crankshaft position sensor indicates that the valves and pistons are in a timed position an electronic solenoid releases that allows the inner and outer discs to synchronize and spin together. Once the discs of the torque converter are rotating together, the camshaft 40 is enabled to rotate for operation through a properly timed engine.

Figure 2:
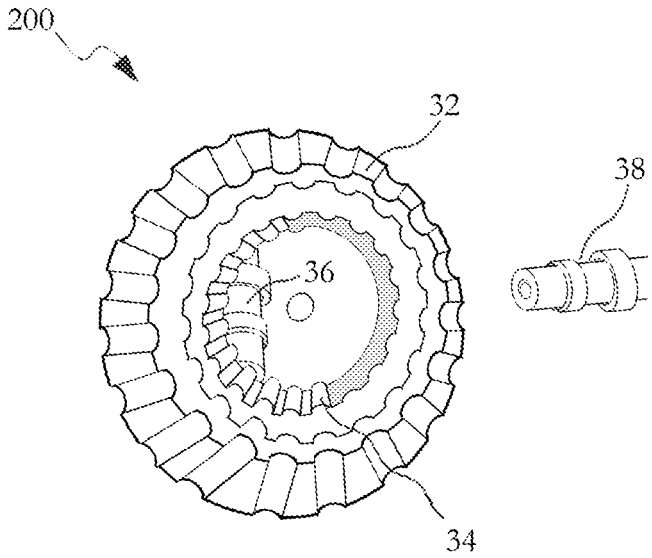
FIG. 2 depicts a second embodiment of the present invention to ensure proper timing of an internal combustion engine.
Figure 3:
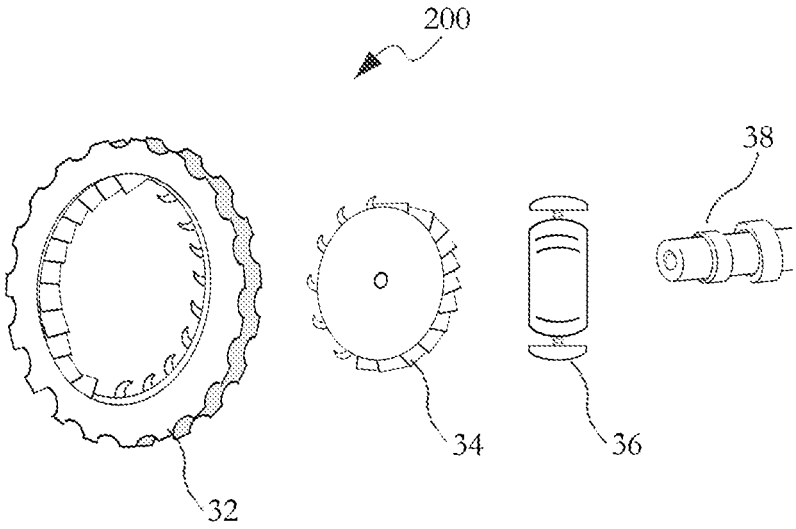
FIG. 3 depicts an exploded view of the components of the second embodiment in accordance with the present invention.

FIG. 2 provides a second embodiment of the present invention, which is used in conjunction with a crankshaft. A gear assembly 200 is shown in FIG. 2. The crank gear assembly 200 includes an outer ring 32 and an inner ring 34. A brake 36 is provided in the inner ring 34 to prevent movement until sensors in the vehicle have confirmed proper timing of the engine. In this particular embodiment, the inner ring 34 and outer ring 34 turn together, a timing belt turns where the outer ring 34. Upon confirmation that the valves and pistons have been properly timed, the outer ring 34 rotates in conjunction with the rotation of the camshaft and the outer ring 32 synchronizes with the inner ring 34 which is allowed to rotate upon the release of the brake 36. Once turning together, the outer ring 32 and inner ring 34 enable the rotation of a crankshaft 38. In reference to FIG. 3, an exploded view of this crankshaft gear assembly 200 in accordance with the present section is depicted specifically the outer ring 32, inner ring 34 and brake 36. Both embodiments of the mechanism for engine timing confirmation provide a means to detect and confirm proper timing of the engine prior to the release of the camshaft. The instant invention has been shown and described in what it considers to be the most practical and preferred embodiments. It is recognized, however, that departures may be made there from within the scope of the invention and that obvious modifications will occur to a person skilled in the art.

What is claimed is:

1. A cam gear assembly for confirming proper engine timing within an internal combustion engine comprising:

a. a drive unit;

b. a torque converter, where the torque converter joins to the drive unit and the torque converter includes a first disc and second disc;

c. a gear housing, wherein the first disc and second disc form the gear housing, the first disc is an outer gear and second disc is the inner gear filled with oil between blades of the outer gear and inner gear during operation; and d. a camshaft, where the camshaft is connected to the cam gear assembly, where an input shaft is provided for the connection of the cam gear assembly to the camshaft, where during operation, the first disc spins by force supplied by a drive belt, a magnet sensor located above the first disc senses the speed of the first disc and the second disc, once these first disc and outer disc reach a coupling speed a crankshaft position sensor indicates that valves and pistons within the internal combustion engine are in a timed position, an electronic solenoid releases that allows the first disc and second disc to synchronize and spin together, once the first disc and second disc of the torque converter are rotating together, the camshaft is enabled to rotate for operation through a properly timed engine.

* * * * *